United States Patent [19]

Fuchs, Jr.

[11] Patent Number: 4,687,422

[45] Date of Patent: Aug. 18, 1987

[54] CONTINUOUS EXTRUSION APPARATUS

[76] Inventor: Francis J. Fuchs, Jr., P.O. Box 10016, Naples, Fla. 33941

[21] Appl. No.: 868,519

[22] Filed: May 30, 1986

Related U.S. Application Data

[62] Division of Ser. No. 714,905, Mar. 22, 1985, Pat. No. 4,663,699.

[51] Int. Cl.[4] ..... F04B 9/10

[52] U.S. Cl. ..... 417/345; 91/191; 417/347

[58] Field of Search ..... 417/344–347; 91/191

[56] References Cited

U.S. PATENT DOCUMENTS

| | | | |
|---|---|---|---|
| 730,179 | 6/1903 | Vogel | 417/346 X |
| 2,031,456 | 2/1936 | Blunt | 91/191 X |
| 2,212,667 | 8/1940 | Mayer | 417/346 |
| 2,274,224 | 2/1942 | Vickers | 91/191 X |
| 2,528,131 | 10/1950 | Garretson | 91/191 X |
| 3,773,438 | 11/1973 | Hall et al. | 417/346 X |
| 4,555,220 | 11/1985 | Hall et al. | 417/346 X |

FOREIGN PATENT DOCUMENTS

| | | | |
|---|---|---|---|
| 65386 | 3/1950 | Netherlands | 417/344 |
| 456232 | 11/1936 | United Kingdom | 417/345 |

*Primary Examiner*—Carlton R. Croyle
*Assistant Examiner*—Theodore Olds
*Attorney, Agent, or Firm*—R. Gale Rhodes, Jr.

[57] ABSTRACT

A dual pump is disclosed in which a single valve controls flow of power fluid to the pump piston. Cams on the pistons and push rods on the valve interact to control the valve timing.

1 Claim, 29 Drawing Figures

(NOTE FIG. 6 U.S. PAT. NO 3,985,011)

FIG. 7
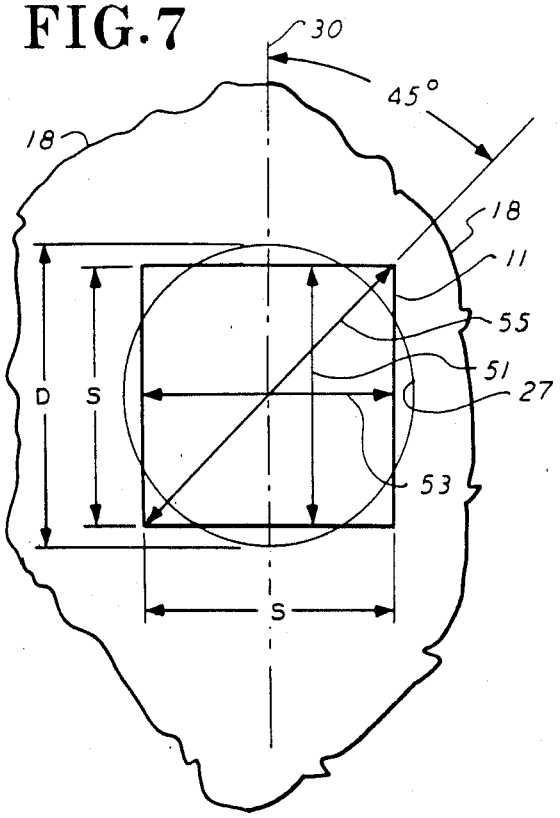
FIG. 8
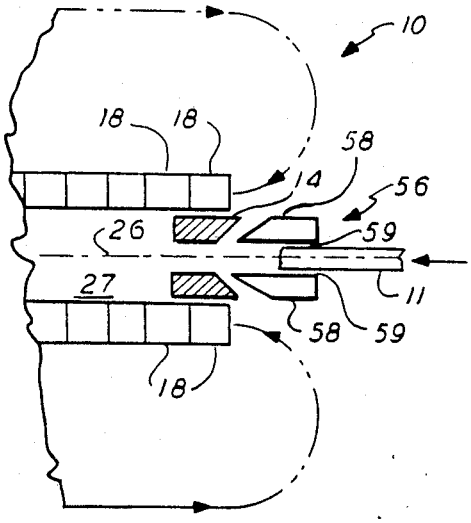
FIG. 10
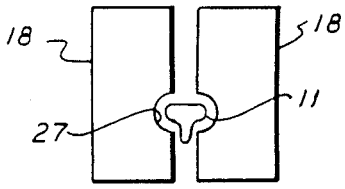
FIG. 9
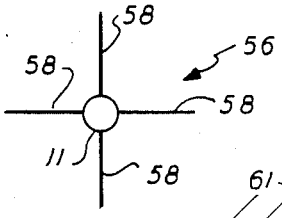
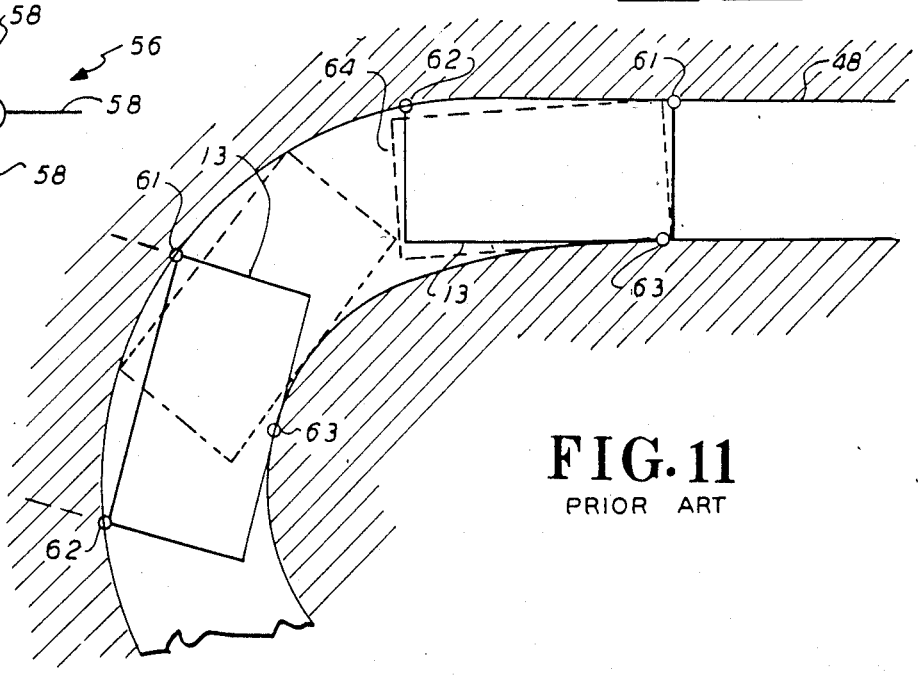
FIG. 11
PRIOR ART FIG. 12
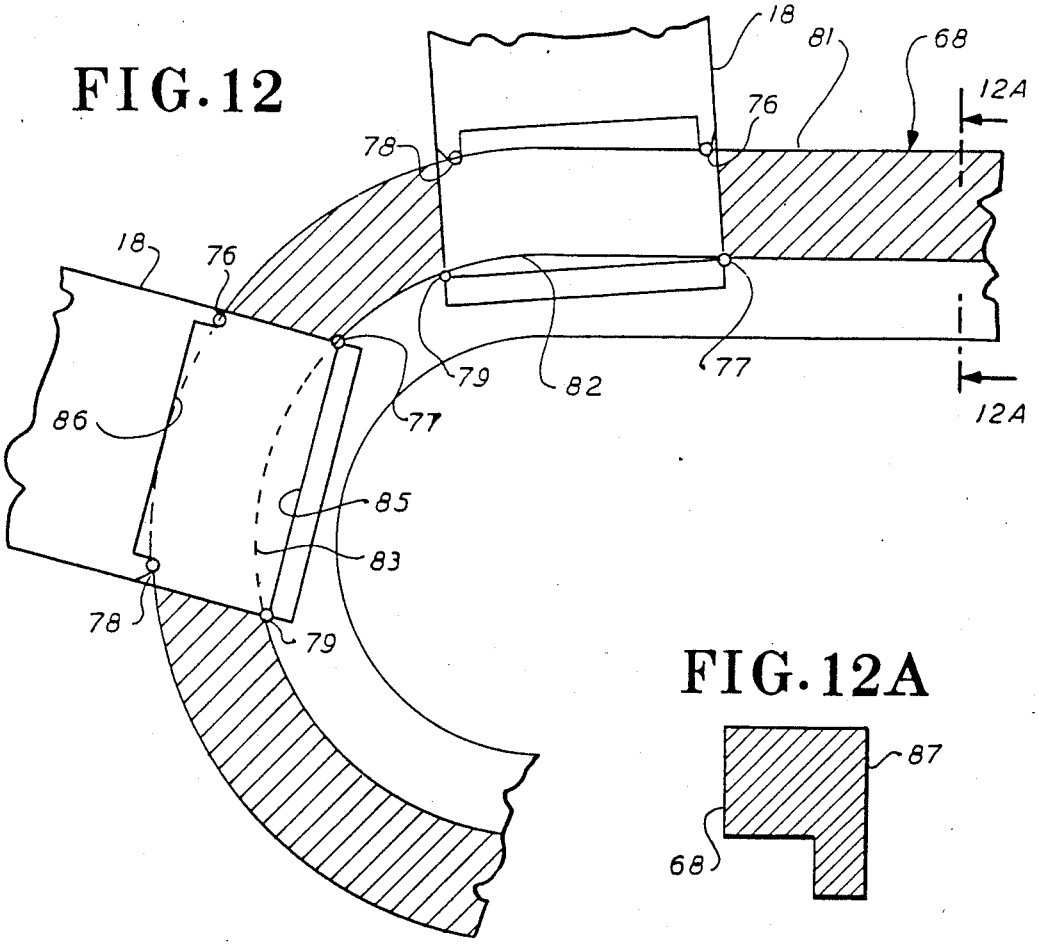
FIG. 12A
FIG. 14
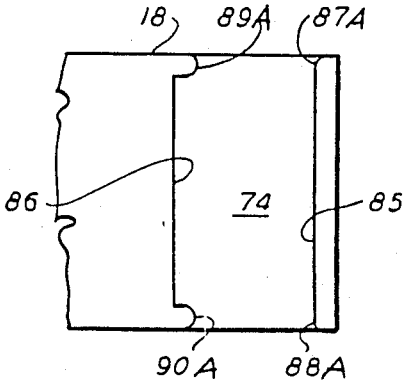
FIG. 13
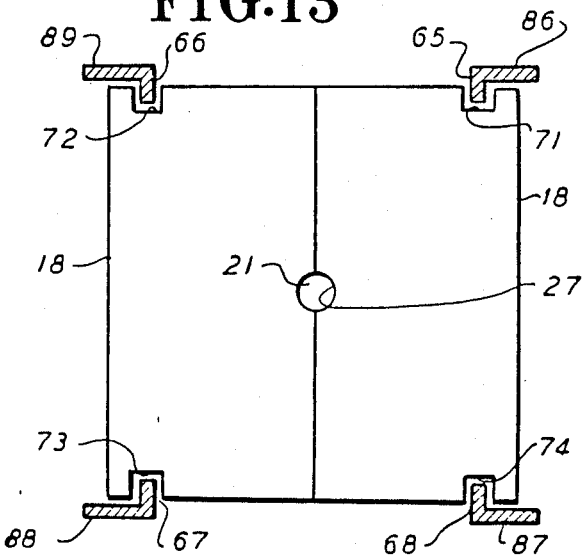

FIG. 15
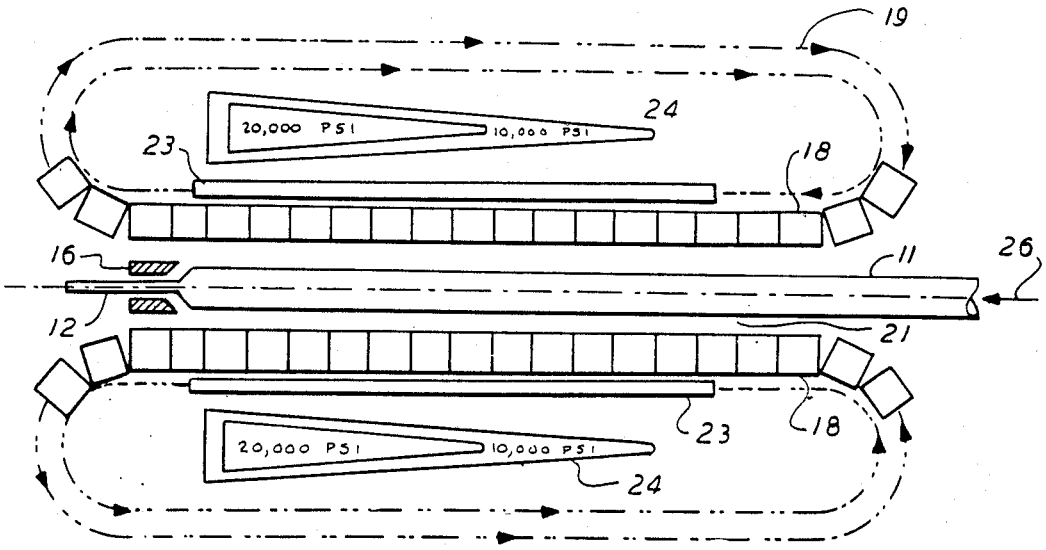
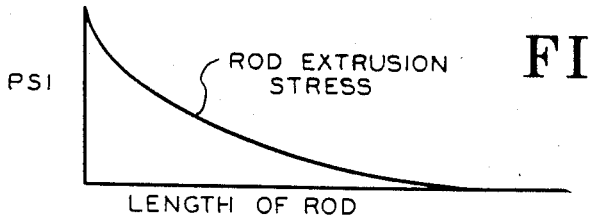
FIG. 16
FIG. 17
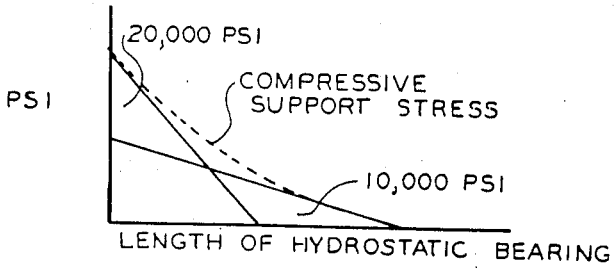

FIG. 18
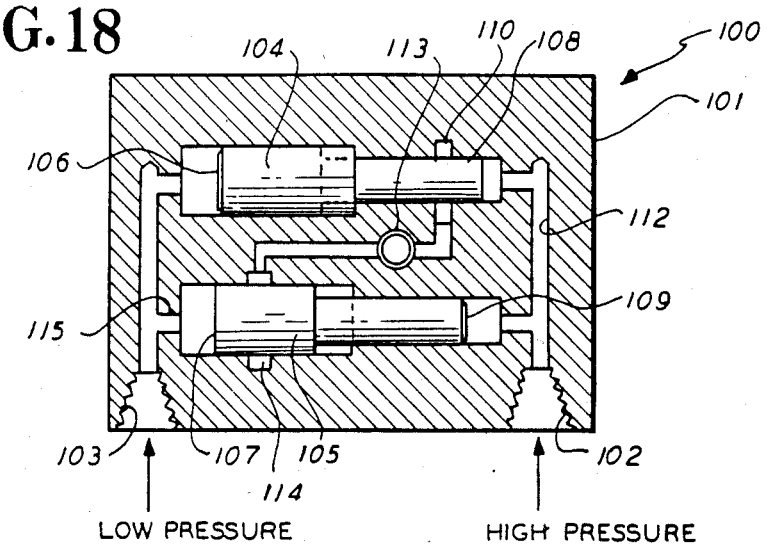
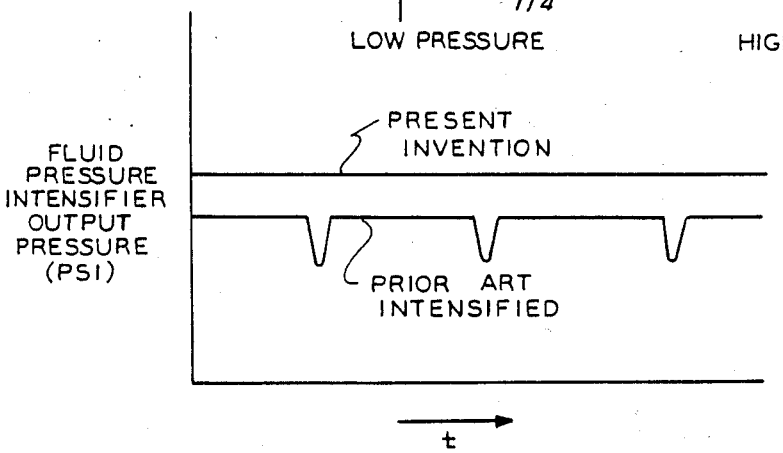
FIG. 20
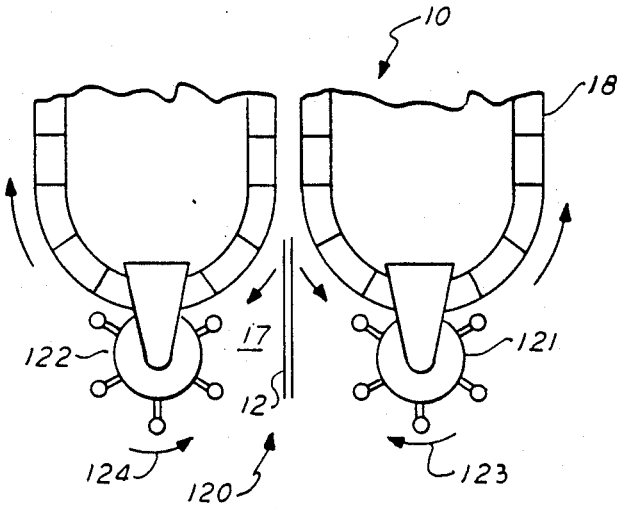
FIG. 22

FLUID PRESSURE FROM INTENSIFIER 202 (FIG. 19)
PRIOR ART DRIVE MOTOR GEARS MOTORS 31-35 U.S. PAT. NO. 3,985,011
DRIVE
AXIAL COMPRESSIVE BIAS
DIE
10
11
12
16
18
26
121
125
126
128
129
130
131
133
135
137
139
1354
1374
300
301
302
303
304
305
306
307
310
311
314

CONTINUOUS EXTRUSION APPARATUS

This is a division of application Ser. No. 714,905, filed Mar. 22, 1985, now U.S. Pat. No. 4,633,699.

BACKGROUND OF THE INVENTION

My present invention relates generally to apparatus for deforming a workpiece and more particularly to apparatus for continuously extruding a rod of indefinite length to produce a wire of indefinite length.

It will be understood by those skilled in the art that my present invention is an improvement in my prior inventions disclosed in U.S. Pat. Nos. 3,740,985, issued June 26, 1973 (reissued May 4, 1976 as U.S. Pat. No. Re. 28,795) and U.S. Pat. No. 3,985,011, issued Oct. 12, 1976, and in particular is an improvement in my invention disclosed in the latter patent. Accordingly, it will be further understood that the disclosure of U.S. Pat. No. 3,985,011 is hereby incorporated herein by reference and only the improvements over my invention disclosed in U.S. Pat. No. 3,985,011 are disclosed and claimed herein. Still further, it will be understood that my present invention may be utilized for the continuous extrusion of tubing of larger diameter and larger wall thickness into tubing of smaller diameter and smaller wall thickness, particularly upon the apparatus of my U.S. Pat. No. 3,985,011 being modified in accordance with my invention of U.S. patent application Ser. No. 449,561, filed Dec. 13, 1982, entitled METHODS OF AND APPARATUS FOR CONTROLLING THE GAP BETWEEN A MANDREL AND DIE DURING EXTRUSION, and as taught therein. Accordingly, it will be understood that while my present improved invention is taught in terms of extrusion of rod into wire, such invention may be utilized to extrude tubing when modified in accordance with my above-noted pending patent application. Hence, it will be understood that as used herein the expression "elongated workpiece" is used to means, inter alia, rod of indefinite length or tubing of indefinite length and of larger diameter and larger wall thickness, and the expression "elongated product" is used to mean inter alia, wire and tubing of smaller diameter and smalelr wall thickness.

While the inventions of my above-mentioned prior patents perform reasonably well, instability has been experienced in maintaining relative geometric shape and coaxial alignment between the input rod, bore of moving chamber provided by the moving gripping element members and the bore of the extrusion die. Such coaxial misalignment can cause undesirable marking, cutting and shaving of the rod. Shaved particles can lodge between the moving gripping element members and cause leakage of the pressure medium or hydrostatic fluid and damage of the extrusion die O.D. Also, in extreme cases, it has been found that the bore diameter of the moving chamber provided by the moving gripping element members was larger than the rod diameter allowing slippage between the gripping element members and rod causing interruption and occasionally cessation of rod advancement and hence cessation of extrusion. Accordingly, it has been found that there is a need in the art of improvements for maintaining the rod, the centrally apertured chamber, and the extrusion die in coaxial alignment with the center-line of the extrusion apparatus during extrusion of the rod and for maintaining the centrally apertured chamber in circular geometric shape.

DESCRIPTION OF THE DRAWINGS

FIG. 7 is a diagrammatical illustration of an improvement of the present invention wherein the entering rod to be extruded is provided with a generally rectangular cross-sectional shape to provide keying action to the gripping elements cooperating to form the centrally apertured moving extrusion chamber;

FIGS. 8–10 illustrate an improvement of the present invention including quadrantly oriented alignment guides to facilitate maintaining the rod to be extruded in coaxial alignment with the center-line of the extrusion apparatus;

FIGS. 11–14 are diagrammatical illustrations of an improvement of the present invention wherein the cooperative structure between the improved track for supporting the gripping elements during their movement and the gripping elements provide at least four points of contact between the gripping element members and the track at all positions along the track;

FIGS. 15–17 illustrate diagrammatically and graphically an improvement of the present invention wherein the novel hydrostatic bearings provide matching compressive support stress closely matching the rod extrusion stress;

FIG. 18 is a cross-sectional illustration of an improvement of the present invention embodied as a novel pressure ratio valve for maintaining a predetermined pressure ratio between two pressures;

FIG. 20 is a comparative graph illustrating the improved output of the fluid pressure intensifier of the present invention as compared to the output of a typical prior art fluid pressure intensifier;

FIG. 22–24 illustration an improvement of the present invention embodied as novel apparatus for removing particles of extrudant, such as wire, which may enter between and adhere to the sides of the gripping element members of the extrusion apparatus of the present invention;

FIGS. 25 and 26 are diagramamtical illustrations of an improvement of the present invention embodied as novel axial compression gear system for providing axial compressive bias to the gripping element members of the continuous extrusion apparatus of the present invention.

DETAILED DESCRIPTION OF THE PREFERRED EMBODIMENT

Figure 1:
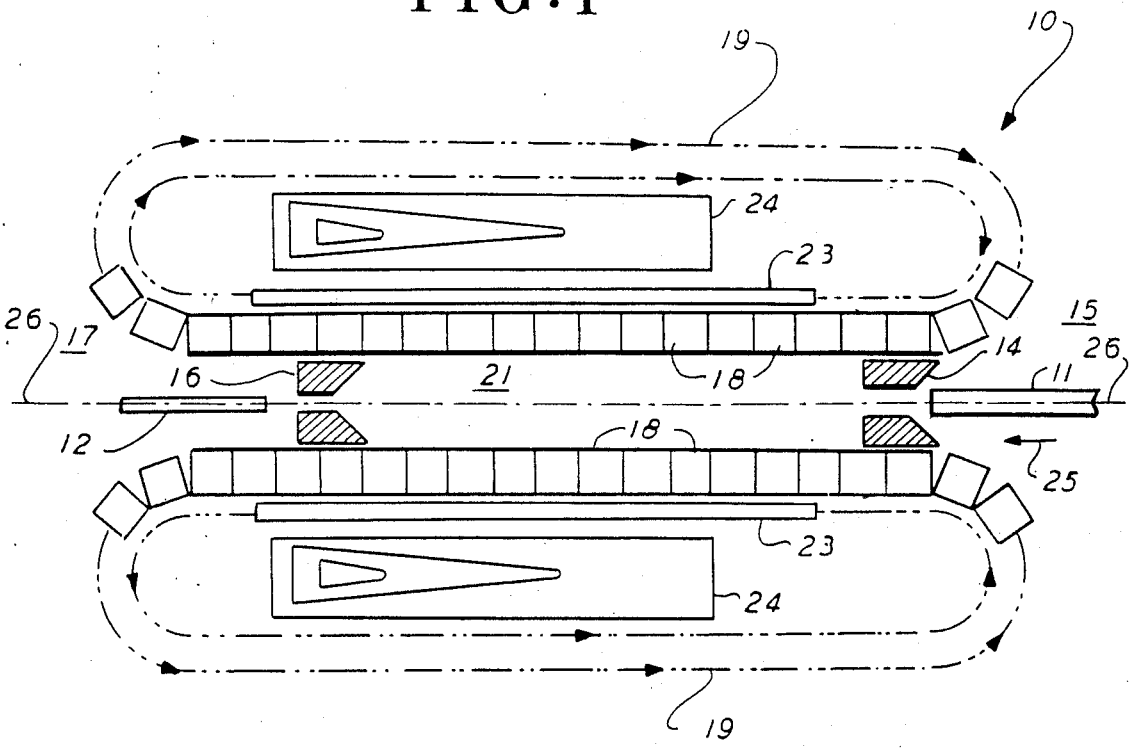
FIGS. 1 and 2 are diagrammatical illustrations of improved continuous extrusion apparatus embodying the present invention.

Referring initially to FIG. 1, continuous extrusion apparatus in accordance with the improvement of the present invention is shown. The apparatus 10, as the apparatus 10 of U.S. Pat. No. 3,985,011, may be utilized for the continuous hydrostatic extrusion of an elongated workpiece of indefinite length, such as, for example, rod 11, to form an elongated product likewise of indefinite length, such as, for example, wire 12. The apparatus 10 of the present improvement invention, FIGS. 1 and 2, includes a sizing die 14 illustrated in cross-section and located at the entrance end 15 of the apparatus 10 and an extrusion die 16 also shown in cross section and located at the exit end 17 of the apparatus. The continuous extrusion apparatus 10 of the present invention, unlike the extrusion apparatus of U.S. Pat. No. 3,985,011 which includes four trains of gripping element members 13, includes only two groups or trains of gripping element members 18 adapted to be driven continuously around endless paths 19, converging at the entrance end 15 and diverging at the exit end 17, to provide a succession of central apertures or bores 27 (FIG. 2) which provide a continuous moving pressure chamber, indicated by general numerical designation 21 (FIG. 1), extending between the entrance end 15 of the apparatus and the exit end 17, also in the same general manner, except for the improvements set forth herein, as the groups or trains of gripping element quadrants 13 of U.S. Pat. No. 3,985,011. As may be better understood by reference to both FIGS. 1 and 2, the endless paths 19 of the two trains of gripping element members 18 converge about the rod 11 (coated with a suitable pressure or shear force transmitting medium as taught in the incorporated patent) at the entrance end 15 of extrusion apparatus 10 such that successive sets of two gripping element members 18, one from each train, cooperate to form a succession of gripping elements 20 (FIG. 2) and a central aperture or bore 27 encircling the successive portions of the surface of the coated rod 11 passing through the continuous moving pressure chamber 21 (FIG. 1). As taught in detail in U.S. Pat. No. 3,985,011, incorporated herein by reference, shear forces are transmitted to the rod 11 in the direction of the arrow 25 (FIG. 1) to cause the rod to continuously advance with the gripping elements 20 providing the continuous moving pressure chamber 21 toward the extursion die 16 and, at the same time, increasing compressive support stress or forces are applied to the advancing rod 11 by the gripping elements 20 which forces increase in the direction of the arrow 25 due to the increasing hydrostatic pressure applied to the sides of the gripping element members 18 by the hydrostatic bearings 24 (FIG. 1) through the moving endless belts 23 (FIG. 1) in the same general manner that such increasing radial compressive pressure is applied to the gripping element members 13 of U.S. Pat. No. 3,985,011 by the pressure pads 51 and endless belts 59 of FIG. 5, 6 and 8 of such Patent. As further taught in detail in incorporated U.S. Pat. No. 3,985,011, the pressure applied to the rod 11 moving through the continuous moving pressure chamber 21 builds up to a sufficient level upstream of the extrusion die 16 to increase the ductility of the rod sufficiently whereupon the rod is caused to pass through the extrusion die 16 and is hydrostatically extruded into wire 12. The continuous extrusion apparatus 10 has a center-line 26 extending therethrough, and it will be understood that in accordance with the teachings of the present invention that the present improvement is for maintaining the rod 11, centrally apertured continuously moving chamber 21 and extrusion die 16 in coaxial alignment with the center-line 26 during continuous hydrostatic extrusion of wire 12 and for maintaining the centrally apertured continuously moving chamber, or the bore thereof, in substantially circular geometric shape; such improvements will now be described.

Figure 3:
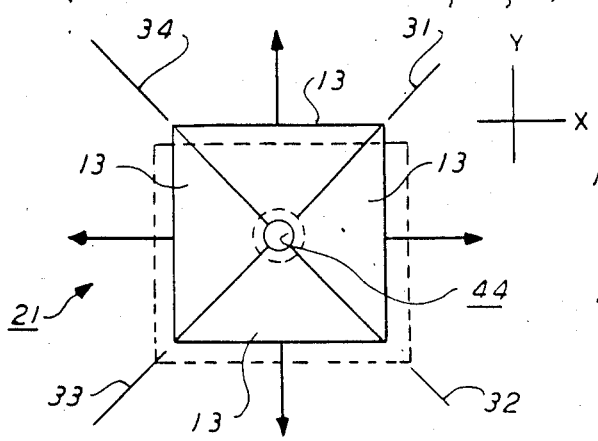
FIG. 3 PRIOR ART
FIG. 3 is a diagrammatical illustration of the prior art problem of four planes of possible separation between gripping element members of the four trains of such gripping element members known to the prior art.
Figure 4:
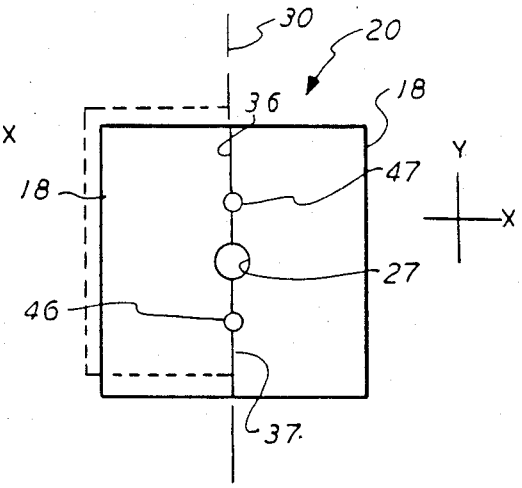
FIG. 4 is a diagrammatical illustration of an improvement of the present invention where the possible planes of separation between gripping element members is limited to one plane of possible separation.

It has been discovered that limiting the plurality of trains of gripping element members 18 to only two trains of gripping element members reduces the possible number of planes of separation between the gripping element members 18 when cooperating to form the gripping element 20 (FIG. 2), the bore 27 (FIG. 2) and the continuous moving chamber 21 (FIG. 1) to only one possible plane of separation, namely single plane of separation 30 of FIG. 4 which plane of separation 30 is defined by the opposed mating surfaces 36 and 37 of the gripping element members 18. To the contrary, upon the four trains of gripping element quandrants or members 13 of U.S. Pat. No. 3,985,011 cooperating to form the gripping element 21 (FIG. 3 of U.S. Pat. No. 3,985,011), four possible planes of separation exist between such four gripping element members 13 as illustrated by the four planes of possible separation 31, 32, 33 and 34 of FIG. 3. It will be noted from reference to FIG. 3, illustrative of the gripping element members 13 of U.S. Pat. No. 3,985,011, that the use of four trains of gripping element members or quadrants 13 permits relative movement between the members in both the X and Y directions as shown, and it will be further understood that even if the contiguous surface of the gripping element members 13 remains in engagement, relative movement of the entire gripping element 21 formed cooperatively by the four gripping element members 13 could occur, as indicated by the dashed outline in FIG. 3, thereby distorting at least a portion of the central bore or aperture 44 providing the continuously moving pressure chamber. With the use of only two trains of gripping element members 18 in accordance with the teaching of the present invention and as illustrated in FIG. 4, at least one half of the prior art problem indicated in FIG. 3 is solved in that relative movement can only take place in one direction along the single plane of separation 30 in the X direction and, in accordance with the further teachings of the present invention set forth below, the keying arrangement between the gripping element members 18 solves the other half of the problem. Accordingly, it will be understood from FIG. 4 that by reducing the number of trains of gripping element members 18 to only two, relative movement between the trains of gripping element members 18 when cooperating to form the gripping elements 20 and the continuously moving chamber 21 (FIG. 1) is restricted to movement in the single plane of separation whereby coaxial alignment of the continuously moving chamber 21 with the center-line 26 (FIG. 1) and maintenance of the continuously moving chamber 21 in circular cross-sectional shape, are facilitated.

Figure 5A:
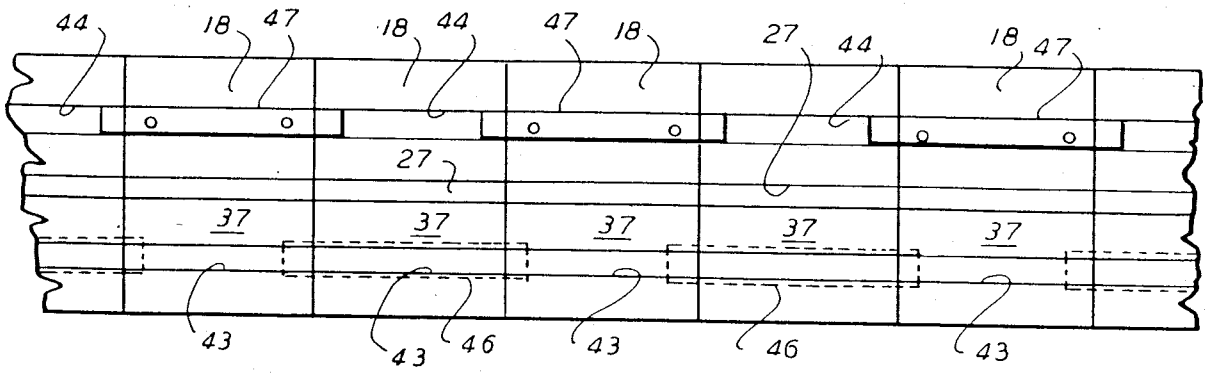
FIGS. 5A and 5B are diagrammatical illustrations of an improvement of the present invention utilizing keying members to facilitate coaxial alignment of the continuously moving pressure chamber with the center-line of the extrusion apparatus.
Figure 5B:
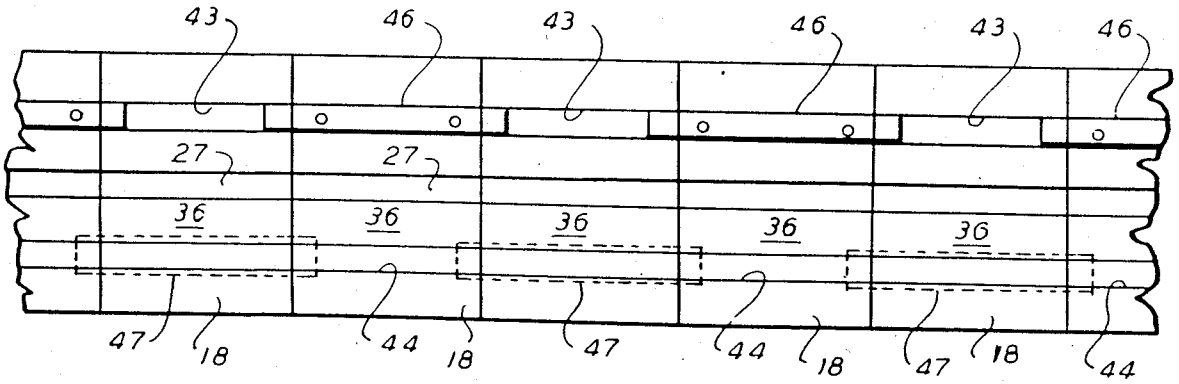
Figure 6:
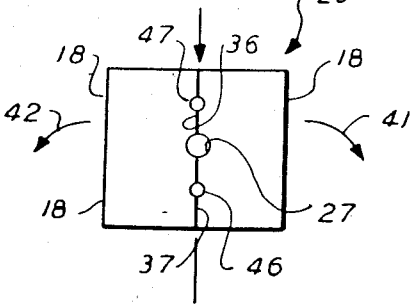
FIG. 6 is a diagrammatical illustration illustrating, inter alia the orientations of the diagrammatical illustrations of FIGS. 5A and 5B.

Referring again to FIG. 4 and now to FIGS. 5 and 6, it will be further understood in accordance with the teaching of the present invention that keying members 46 and 47 (FIG. 4) are provided between the opposed mating surfaces 36 and 37 of the gripping element members 18 to facilitate coaxial alignment of the continuously moving chamber 21 with the center-line 26 of the extrusion apparatus 10 and maintenance of the cross-sectional shape of the chamber 21 in circular or round configuration. Shown in FIGS. 5A and 5B are views of opposed mating surfaces 36 and 37 of successive gripping element members 18 upon the gripping element members being pivoted away from each other in the direction of the arrows 41 and 42 of FIG. 6. Grooves 43 and 44 are formed, respectively, in the lower and upper portions of the mating surfaces 36 and 37 and as shown in FIG. 5B, alternate ones of the gripping element members 18 are provided with keying members 46 fixedly secured in the lower grooves 43, and as shown in FIG. 5A different alternate ones of the gripping elements 18 are provided with keying members 47 fixedly secured in the upper grooves 44, and it will be noted and understood that the keying members 46 and 47 are staggered with respect to each other. It will be further noted that the keying members 46 and 47 are longer than the width of each gripping element member 18 whereby upon the gripping element members cooperating to form the gripping elements 20, bore 27 (FIG. 6) and moving centrally apertured chamber 21 (FIG. 1), the keying members 46 and 47 extend entirely across one gripping element member 18 and portions of the adjacent gripping element members for positive keying of the succession of gripping elements 20 providing the continuously moving chamber 21 (FIG. 1). More particularly, it will be understood that upon the gripping element members 18 cooperating to form the gripping elements 20 (FIG. 6), the keying members 46 fixedly secured in the lower grooves of alternate ones of gripping element members 18 of FIG. 5B reside in the lower grooves 43 of alternate ones of the gripping element members 18 as shown in dashed outline in FIG. 5A, and the keying members 47 fixedly secured in the upper grooves of alternate ones of gripping element members 18 of FIG. 5A reside in the upper grooves 44 of alternate ones of the gripping elements 18 as shown in dashed outline in FIG. 5B; it will be understood that the dashed outlines representing the keying members are oversized for ready identification and clairty of understanding and that in actuality the keying members are dimensioned for close receipt within the grooves. Accordingly, it will be understood that upon the keying members being positioned as described and shown, positive keying action is provided between the succession of gripping elements 20 (FIG. 2) as they move from the entrance end 15 to the exit end 17 of extrusion apparatus 10 to provide the continuously moving chamber 21 (FIG. 1) and thereby facilitate maintenance of the chamber 21 in coaxial alignment with the centerline 26 of extrusion apparatus 10 and in coaxial alignment with the rod 11 and extrusion die 16, also such positive keying action facilitates maintenance of the centrally apertured bore 27 (FIG. 4) in circular or round geometric shape or configuration.

Figure 2:
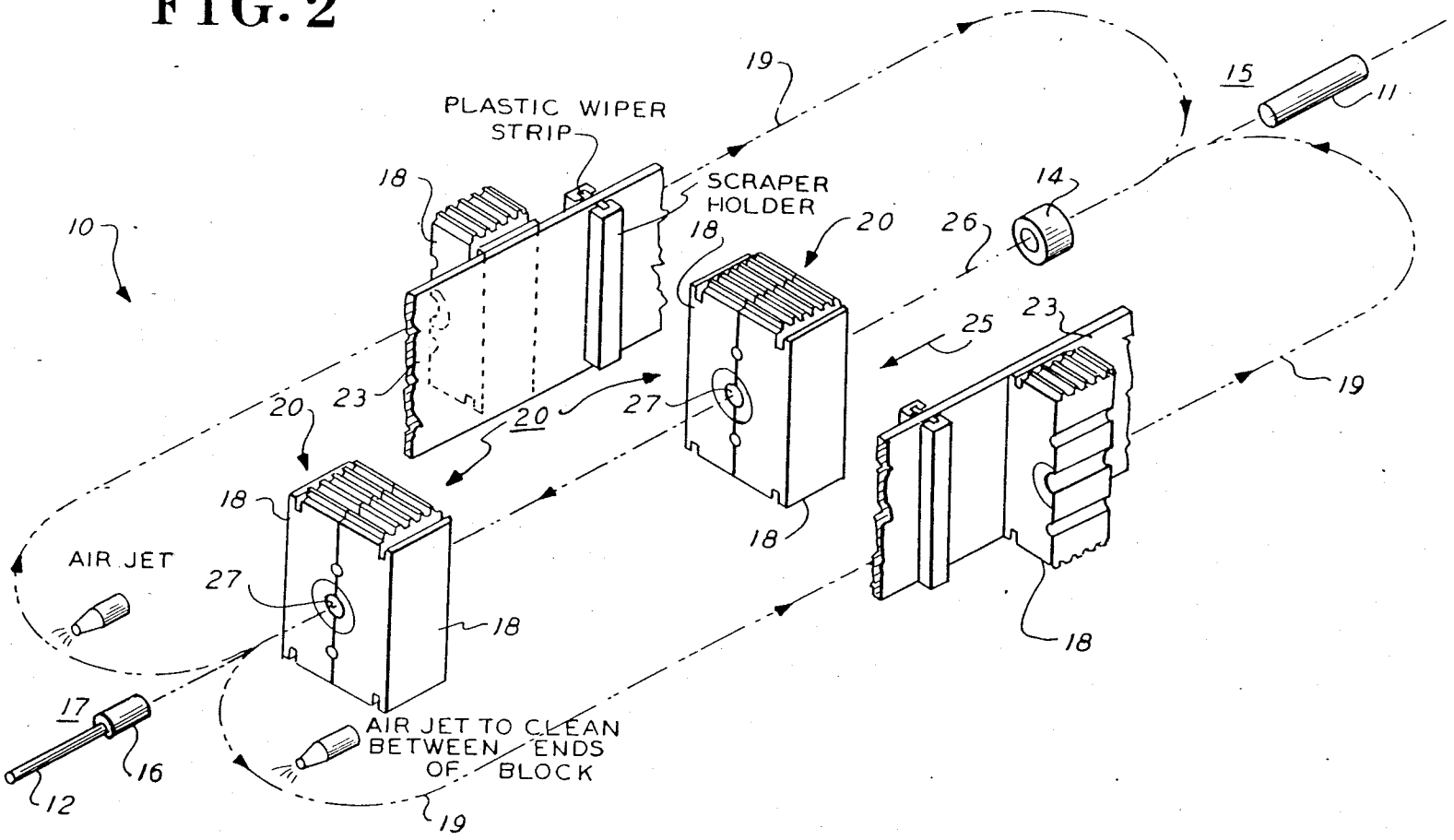

Referring now to FIG. 7, a further improvement of the present invention for maintaining the centrally apertured chamber 21 (FIG. 1) in coaxial alignment with the apparatus center-line 26 during extrusion of the wire 12 and for maintaining the central apertures or bores 27 (FIG. 2), and hence the centrally apertured chamber 21 (FIG. 1) in circular or round geometric shape during extrusion, will be set forth. The sizing die 14 (FIGS. 1 and 2) provides the entering rod 11 with the generally rectangular cross-sectional shape shown in FIG. 7, and it will be understood that for clarity of understanding the cross-sectional shape of the rod 11 is shown exaggeratedly enlarged with respect to the cross-sectional shape of the bore 27 provided by the mating gripping elements 18 separated by the plane of separation 30 which plane of separation 30 is the same as that shown in FIG. 4. It will be noted that the cross-sectional width and height S of the rod 11 is smaller than the cross-sectional shape or diameter D of the bore 27. Hence, it will be understood that in accordance with the teaching of the present invention the cross-sectional shape of the rod 11 in any plane parallel or perpendicular to the plane of separation 30, as indicated by the arrows 51 and 52, is smaller than the corresponding cross-sectional dimension, diameter D, of the centrally apertured chamber or bore 27; the smaller cross-sectional dimension S of the rod 11 cooperates with the centrally apertured chamber or bore 27 to provide four passageways extending through the centrally apertured bore 27 and along the rod 11 for the transmission of lubricating fluid to the extrusion die 16 (FIGS. 1 and 2). Further, it will be understood in accordance with the teachings of the present invention, that the rod 11 in any plane displaced angularly at substantially 45° with respect to the plane of separation 30, as indicated by arrow 55, is larger than the corresponding cross-sectional dimension, or diameter D, of the centrally apertured chamber or bore 27 and this larger cross-sectional dimension of the rod 11 provides keying action upon the rod 11 engaging the two trains of gripping elements 18 cooperating to form the centrally apertured chamber or bore 27 which facilitates alignment of the gripping element members 18 with respect to the extrusion apparatus center-line 26 and also facilitates maintenance of the centrally apertured chamber 21 or bores 27 in round or circular geometric shape.

In accordance with the further teachings of the present improvement invention, and referring to FIGS. 8–10, it will be understood that the present improved invention includes an alignment guide indicated by general numerical designation 56, located upstream of the centrally apertured chamber 21 and sizing die 14, which alignment guide engages the rod 11 to facilitate maintaining the rod in coaxial alignment with the apparatus center-line 26. As may be best understood from FIG. 8 and 9, the alignment guide 56 comprises a plurality of radially disposed (quadrantly disposed in the preferred embodiment as illustrated in FIG. 9), guide members 58 having inner edges 59 (FIG. 8) displaced radially outward a distance from the extrusion apparatus center-line 26 and the edges 59 are for engaging the outer surface of the rod 11, as may be better understood from FIG. 9, to align the rod 11 with the apparatus center-line 26. It will be understood from reference to FIG. 10 that if concentricity is not maintained between the rod 11 and centrally apertured chamber 21, or bores 27, provided by the two trains of gripping elements 18, a portion of the rod 11 can be squeezed or extruded between the gripping elements 18 causing loss of lubricant between the outer surface of the rod and the bore and preventing the gripping elements 18 from mating. However, in accordance with the present improvement invention embodying the alignment guide 56, concentricity is maintained due to the rod 11 being maintained in coaxial alignment with the apparatus center-line 26.

FIGS. 11, 12 and 13 illustrate further teachings of the present improvement invention for maintaining the centrally apertured chamber 21 (FIG. 1) and defining central bores 27 (FIG. 2) in coaxial alignment with the center-line 26 (FIG. 1) of the extrusion apparatus 10 during extrusion of the wire 12 and further for maintaining the centrally apertured chamber 21 and defining bores 27 in round or circular cross-sectional geometric shape; more particularly, FIGS. 12 and 13 illustrate diagrammatically the present novel cooperating track ribs 65, 66, 67 and 68 and gripping element member 18 grooves 71, 72, 73 and 74 for maintaining the gripping element members 18 in processional alignment as they proceed or more continuously around the endless paths 19 (FIG. 1) and especially for maintaining the gripping element members 18 in alignment with the center-line 26 of the extrusion apparatus as they converge at the entrance end 14 (FIG. 1) of the apparatus 10 to provide bores 27 defining the continuously moving centrally apertured pressure chamber 21 for receiving the rod 11 to be continuously extruded. Still more particularly and referring to FIG. 12, it will be understood that the present novel cooperating track ribs and gripping element member grooves provide never less than four locating points or points of contact 76, 77, 78 and 79 at all times as the gripping element members 18 move around the endless path 19 provided by track rib 68 whether the gripping element members are moving along the straight portion 81, transitional portion 82, or curved portion 83 of the track rib 68. To the contrary, in the prior art, and as illustrated diagrammatically in FIG. 11, only three points of contact 61, 62 and 63 are provided between the gripping element members 13 and the track 48 as the gripping element members 13 move in processional alignment around the track for continuous extrusion. Further, it will be noted from FIG. 11 that in the prior art apparatus to accommodate movement of the gripping element members 13 around the transitional and curved portions of the track 48, the transitional and curved portions were of greater width than the straight portion and since only three points of contact 61, 62 and 63 are maintained, the gripping element members could move out of desired position or alignment with respect to the track 48 as indicated by the dashed outline 64 in FIG. 11. This misalignment caused undesirable mismatching between the gripping element members 13 particularly as they converge at the entrance end of the extrusion apparatus to provide the continuously moving central chamber, also, such undesired relative movement or mismatching between the gripping element members 13 and the track 48 caused distortion of the circularity of roundness of the cross-sectional shape of the continuously moving chamber.

Referring again to FIGS. 12 and 13, it will be understood the the pairs of opposed tracks 86 and 87 and 88 and 89 are of generally elliptical configuration and provide the endless paths 19 of FIG. 1. It will be further understood by reference to FIG. 12 that due to the novel cooperating track ribs and gripping element member grooves of the present improvement invention, the track ribs, such as track rib 68, may be of uniform width at its straight portion 81, transitional portion 82, and curved portion 83. Additionally, as may be best seen in FIG. 13, the track ribs 65, 66, 67 and 68 are inwardly extending and are received within the inwardly extending grooves 71, 72, 73 and 74, respectively, provided at the outer portions of the gripping element members 18.

Referring to FIG. 14, there is illustrated in detail the groove, e.g. groove 74 of gripping element member 18 of FIG. 13, for better understanding of the detailed structure of the groove and it will be understood that each gripping element member 18 is provided with a pair of such opposed grooves at opposite ends thereof as illustrated in FIG. 13. Referring specifically to the groove 74 of FIG. 14, it will be understood that the groove 74 is defined by substantially parallel inner wall 85 and outer wall 86, the terms inner and outer being used with respect to the inner and outer walls of the track rib 68 as viewed in FIG. 12. The ends 87A and 88A of the inner wall 85 are curved outwardly and the ends 89A and 90A of the outer wall 86 are curved inwardly as viewed in FIG. 14, and by comparing FIGS. 12 and 14, it will be understood that the four locating points or points of contact 76, 77, 78 and 79 are provided by the curved portions 87A, 88A, 89A and 90A of the inner and outer walls 85 and 86 defining the groove 74. It will be further understood that upon the gripping element members 18 moving along the straight portion 81 of the track rib 68 (FIG. 12), the two inwardly extended rounded portions 89A and 90A (FIG. 14) provide two locating points or points of contact and the parallel portion of the inner wall 85 provides an infinite number of contacts with the track rib 68, and upon the gripping elements 18 moving along the transitional portion 82 and curved portion 83, at least four points of contact or engagement are always maintained between the gripping element members and track ribs.

Referring again to incorporated U.S. Pat. No. 3,985,011 and the summary of the manner of causing continuous hydrostatic extrusion summarized hereinabove, it will be recalled, and referring to FIG. 15, that the trains of gripping elements 18 continuously advance the rod 11 through the continuously moving extrusion chamber 21 and increasing stress is built up in the rod, as indicated by the graph of FIG. 16 superposed above the length of rod 11 in FIG. 15, until the increasing stress is sufficiently great to increase the ductility of the rod whereupon the rod is caused to pass through extrusion die 16 and be hydrostatically extruded into wire 12. As will be further recalled, and as was further summarized hereinabove, increasing compressive support stress or forces are applied to the advancing rod 11 by the trains of gripping element members 18 due to the increasing hydrostatic pressure applied to the sides of the gripping element members 18 (FIG. 15) by the hydrostatic bearings 24 through the moving endless belts 23 in the same general manner that such increasing radial compressive pressure is applied to the gripping element members 13 of U.S. Pat. No. 3,985,011 by the presure pads 51 and endless belts 59 shown in FIGS. 5, 6 and 8 of such patents. For coaxial alignment of the continuous moving chamber 21 with the apparatus center-line 26, and maintenance of the circularity of the crosssectional geometric shape of the continuously moving chamber 21, the inward compressive support stress provided to the gripping element members 18 by the hydrostatic bearings 24 through the endless belts 23 must closely match the rod extrusion stress built up in the rod and illustrated in FIG. 16. Shown in FIG. 17 is a composite graph of compressive support stress closely matching the rod extrusion stress of FIG. 16 and it will be further understood in accordance with the teachings of the present invention that the present improvement invention provides such matching compressive support stress through the novel hydrostatic bearings 24 of FIG. 15 providing two pressure zones, e.g. 10,000 psi and 20,000 psi pressure zones as shown in FIG. 17, and through the novel ratio valve indicated by general numerical designation 100 in FIG. 18. It will be understood that the novel hydrostatic bearings 24, FIG. 15, may be embodied as pressure pads and suitable seals such as, for example, the pressure pads 51 and seals 57 and 58 of FIG. 8 of the incorporated patent.

Figure 19:
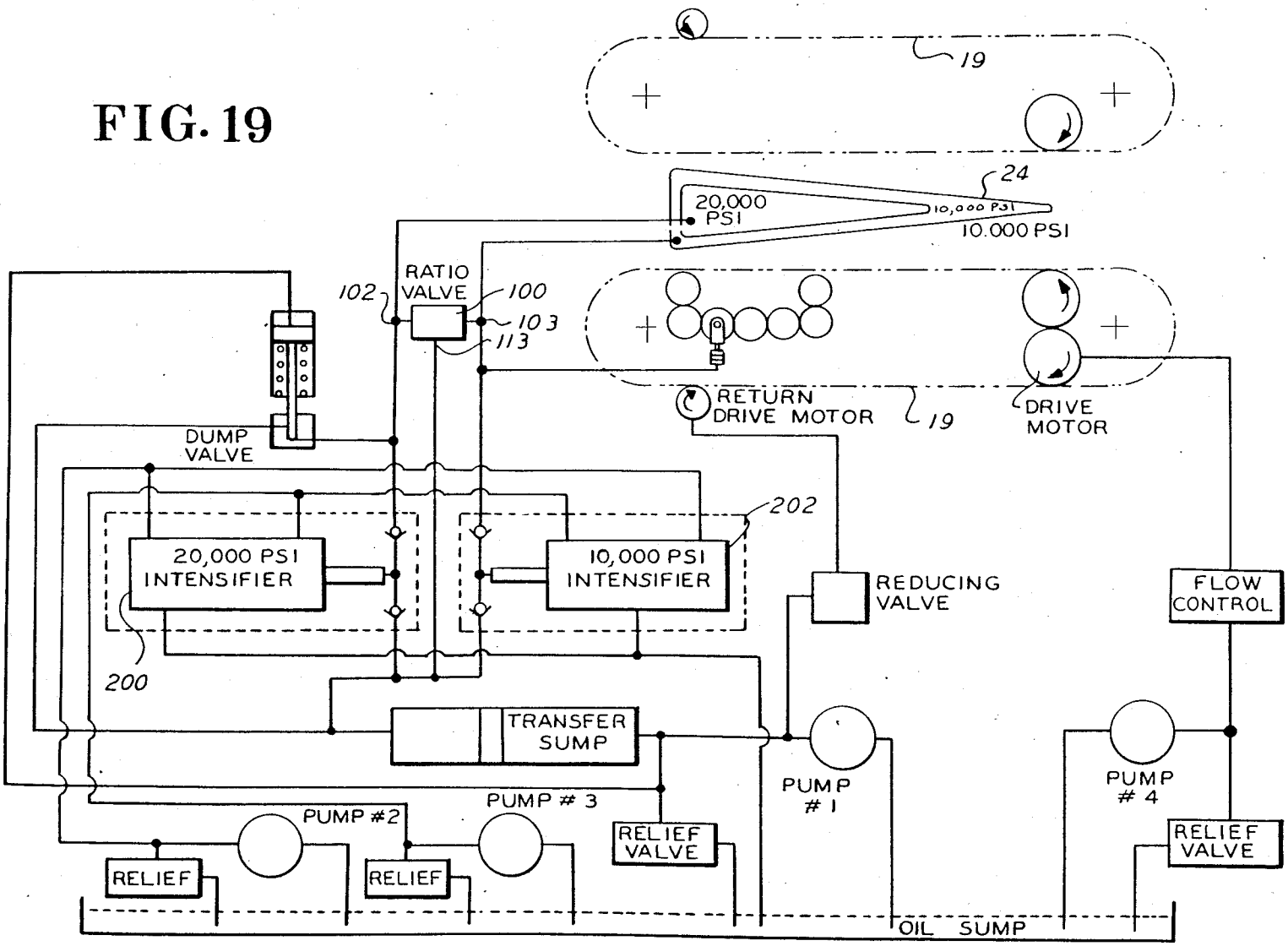
FIG. 19 is a diagrammatical illustration primarily of the hydraulic fluid circuit which may be used by the improved continuous extrusion apparatus of the present invention.

Before describing in detail the novel structure of the pressure ratio valve 100 of FIG. 18, reference will be made, generally, to FIG. 19 which illustrates, diagrammatically, hydraulic control apparatus particularly suitable for use with the present improvement invention. In the upper righthand portion of FIG. 19 are shown the endless paths 19 of the two trains of gripping element members 18 and the hydrostatic bearings 24 (only one being shown but it will be understood that a hydrostatic bearing 24 is associated with each train of gripping element members as illustrated in FIGS. 1 and 15), and in the lower left portion of FIG. 19 is the hydraulic system including the novel pressure ratio valve 100. It will be noted that the ratio valve 100 is connected to two pressure intensifiers, intensifier 200 providing 20,000 psi and intensifier 20 providing 10,000 psi in the embodiment shown. Generally, it will be understood that the novel pressure ratio valve 100 is for providing pressurized fluid from the 20,000 psi intensifier to the inner pressure zone of the hydrostatic bearing 24 and for providing the 10,000 psi pressure to the outer pressure zone of the hydrostatic bearing 24 and, as will be taught in detail below, for novelly maintaining a predetermined ratio between such hydrostatic pressure zones, namely 2:1 in the preferred embodiment illustrated. The pressure intensifiers 200 and 202 are also novel in accordance with the improvement of the present invention and are described in detail below and shown in FIG. 24.

Referring specifically to FIG. 18 and the novel ratio valve 100, the ratio valve 100 includes a body 101 provided with a high pressure inlet port 102 and a low pressure inlet port 103. Mounted reciprocably in the body 101 are a pair of valve spools 104 and 105 having larger leftward ends 106 and 107, respectively, and smaller rightward ends 108 and 109, respectively. It will be understood that the areas of the larger leftward ends are dimensioned with respect to the smalelr rightward ends in the same proportion as the predetermined pressure ratio to be provided by the ratio valve 100; in the preferred embodiment, the larger leftward ends are twice the area of the smaller rightward ends to provide the 2:1 pressure ratio.

In operation, FIG. 19, the high and low pressure inlet ports 102 and 103 (FIG. 18) are connected, repectively, to the high and low fluid pressure intensifiers 200 and 202 which intensifiers, respectively, are for providing relatively high and low pressure, i.e. 20,000 psi and 10,000 psi, pressurized fluid to the high and low pressure zones of the hydrostatic bearing 24 of FIG. 19. Upon the actual pressure ratio between the high and low pressure applied respectively to the inlet ports 102 and 103 being greater than the 2:1 pressure ratio, the spool valve 104 will be moved leftwardly until port 110 is uncovered thereby communicating the high pressure inlet port 102 over channel 112 to the exhaust port 113 which is connected to the oil sump in FIG. 19 whereupon the high pressure is exhausted to the sump until the 2:1 pressure ratio is reestablished. Upon the acutal pressure ratio between the high pressure and low pressure being less than the 2:1 ratio, valve spool 105 moves rightwardly until the port 114 is uncovered thereby communicating the low pressure through conduit 115 to the exhaust port 113 to exhaust the low pressure to the sump until the 2:1 pressure ratio is reestablished. It has been discovered that upon the maintenance of the 2:1 pressure ratio, and as illustrated in FIG. 17, the combined compressive support stress or forces applied by the high and low pressure zones of the hydrostatic bearing 24, FIG. 19, closely matches the rod extrusion stress illustrated in FIG. 16 and hence the inward compressive support stress applied through the endless belts 23 (FIG. 15) to the trains of gripping element members 18, FIG. 15, maintains the keying members 46 and 47, FIG. 5A and 5B, in engagement with their respectively associated grooves 43 and 44 and hence the trains of gripping element members 18 are maintained in coaxial alignment with the extrusion apparatus center-line 26 (FIGS. 1 and 15) and the circularity of the continuous moving chamber 21 (FIGS. 1 and 15) is maintained.

Referring again to the fluid pressure intensifiers 200 and 202 shown in FIG. 19, it will be understood that such fluid pressure intensifiers further embody the present invention and in particular include novel structure providing a continuous, or substantially continuous flow of pressurized fluid pressurized at a constant, or substantially constant, pressure. As is known to those skilled in the prior art, various fluid pressure intensifiers are known but typically fail to provide a continuous flow of pressurized fluid pressurized at a constant pressure. As shown in FIG. 20, the typical prior art fluid pressure intensifier, due to cyclic operation particularly the retraction of pressurizing piston, suffers from a loss of flow of pressurized fluid and suffers from a drop in fluid pressure as the piston, or pistons, are recycled or retracted. Typical of such prior art fluid pressure intensifiers is the one disclosed in my prior invention disclosed in U.S. Pat. No. 4,021,156 issued May 3, 1977; this fluid pressure intensifier can experience surges in various internal fluids pressures causing spurious signals to be produced which untimely reverse or alter the sequence of reciprocation of the pistons 16 and 17 (note FIG. 1) and thereby cause to be produced a non-continuous or fluctating flow of pressurized fluid at a fluctuating or non-constant pressure at the intensifier output. The fluid pressure intensifier of the present invention provides an improvement over such prior art fluid pressure intensifiers by providing, comparatively, a steady state output as indicated by the straight line of the present invention in FIG. 20. As is further known to those skilled in the art, pressurized fluid provided by mechanical pressurizing apparatus including a mechanical drive piston suffers from some of loss of pressurized fluid flow and some loss in fluid pressure and the more such losses in fluid flow and fluid pressure and reduced the greater the efficiency and effectiveness of the fluid pressure intensifier. Accordingly, it will be understood that the fluid pressure intensifier of the present invention greatly improves the loss of pressurized fluid flow and loss of fluid pressure and provides a continuous flow, or at least comparatively (vis-a-vis the prior art) substantially continuous flow of pressurized fluid at a constant pressure, or at least comparatively substantially constant pressure.

Figure 21:
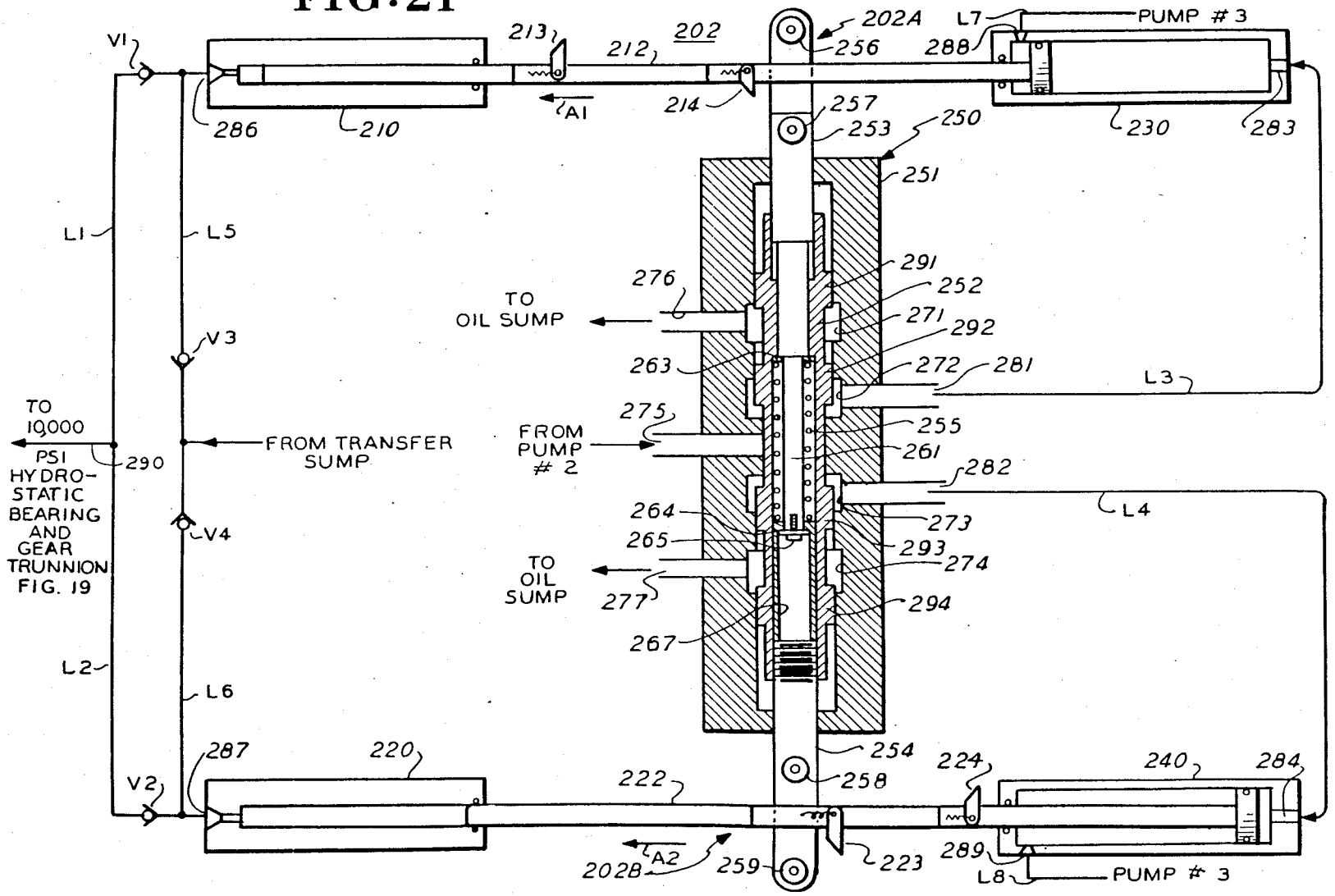
FIG. 21 is a diagrammatical illustration, generally in crosssection, of an improved fluid pressure intensifier embodying the present invention.

A more complete understanding of the structure of the fluid pressure intensifier embodying the present invention may be obtained by reference to FIG. 21 wherein by way of example the detailed structure of the 10,000 psi fluid pressure intensifier 202 embodying the present invention is shown. The fluid pressure intensifier 202 includes first and second high pressure pumps generally designated 202A and 202B, respectively, four-way control valve 250, and an intensifier output 290. Referring to the upper portion of FIG. 21, high pressure pump 202A includes high pressure pump cylinder 210, drive piston 212 and drive cylinder 230 and, referring to the lower portion of FIG. 21, the high pressure pump 202B includes high pressure pump cylinder 220, drive piston 222 and drive cylinder 240; drive pistons 212 and 222 are mounted reciprocably in drive cylinders 230 and 240, respectively, and it will be noted that the drive cylinders 230 and 240 directly drive the pistons 212 and 222. The function of the high pressure pumps 202A and 202B is for independently receiving and pressurizing relatively low pressure fluid admitted to the leftward ends of the high pressure cylinders 220 and 210 from the transfer pump (FIG. 19) and for reciprocably or alternately providing such pressurized fluid at the intensifer output 290 such that a continuous, or substantially continuous, flow of relatively high pressure fluid at a constant pressure, or substantially constant pressure, is provided at the intensifier output 290; the reciprocation sequence of the high pressure pump is controlled by the four-way control valve 250 as described below. It will be noted that piston 212 is provided with a pair of axially displaced and oppositely disposed spring biased cams 213 and 214 and that piston 222 is provided with a pair of axially displaced and oppositely disposed spring biased cams 223 and 224.

The four-way control valve 250 includes a cylinder 251, a spool 252, oppositely disposed upper and lower push rods 253 and 254, respectively, and compression spring 255. The function of the four-way valve 250 is to control the sequence of reciprocation of the drive pistons 212 and 222, and hence the reciprocation sequence of the high pressure pumps 202A and 202B, by controlling the sequence of reciprocation of the drive cylinders 230 and 240. The spool 252 is mounted for relative axial sliding reciprocal movement with respect to and within the cylinder 251, the upper push rod 253 is mounted for relative axial sliding reciprocal movement with respect to and within the upper portion of the spool 252 and the lower push rod 254 is fixedly mounted to the lower portion of the spool 252, such as by the threaded engagement shown, for axial movement therewith. The upper push rod 253 is provided with axially displaced cam followers 256 and 257 for respectively engaging cams 213 and 214 of piston 212 and lower push rod 254 is provided with axially displaced cam followers 258 and 259 for respectively engaging cams 224 and 223 of piston 222. The compression spring 255 surrounds the reduced diameter lower portion 261 of the upper push rod 253 and is mounted between washers 263 and 264; washer 264 resides against the threaded screw 365 fixedly secured to the end of the reduced diameter lower portion 261 of the upper push rod 253 and washer 263 is mounted for relative axial sliding reciprocal movement with respect to the reduced diameter lower portion 261. The minimum spacing between the end of the upper portion of the lower push rod 254 and the washer 264 is determined by the spacing cylinder 267. Generally, upon downward movement of the upper push rod 253 with the spool 252, the washer 263 slides down the reduced diameter portion 261 and acts against the compression spring 255 to compress the spring against the washer 264 and, upon upward movement of the lower push rod 254 and the spool 252, the compression spring 255 is compressed by washer 264 against washer 263 with the reduced diameter lower portion 261 of the upper push rod 253 passing or moving upwardly through the washer 263.

Referring again to the four-way valve 250, cylinder 251 of the four-way valve 250 is provided with internal recesses 271, 272, 273 and 274, an inlet port 275 connected to pump #2 (FIG. 19), outlet ports 281 and 282 connected respectively to lines L3 and L4 which in turn are connected to the rearward inlet ports 283 and 284 of the drive cylinders 230 and 240 respectively. The spool 252 is provided with external annular shoulders 291, 292, 293 and 294 for cooperating with the cylinder internal annular recesses 271, 272, 273 and 274 to effectively open and close the inlet and outlet ports of the four-way valve 250.

Referring again to the leftward portion of FIG. 21, it will be noted that the leftward ends of the high pressure pump cylinders 210 and 220 are provided, respectively, with inlet ports 286 and 287, connected respectively over lines L5 and L6 and through one-way valves V3 and V4 to the transfer sump (FIG. 19). Referring again to the rightward portion of FIG. 21, the leftward ends of drive cylinders 230 and 240, respectively, are provided with inlet ports 288 and 289 for being constantly connected to pump #3 (FIG. 19) of the respective lines L7 and L8. The high pressure pump cylinders 210 and 220, drive cylinders 230 and 240 and four-way valve 250 are mounted fixedly with respect to each other as shown, such as for example by each being mounted stationarily in the relative positions shown in FIG. 21.

It will now be assumed that the above-described structure of the fluid pressure intensifier 202 occupies the central position shown in FIG. 21 with the drive pistons 212 and 222 moving leftwardly under the influence of the drive cylinders 230 and 240 as indicated by the respective arrows A1 and A2 whereupon it will be noted that the cams 213 and 214 mounted on drive pistons 212 have passed by their respective cam followers 256 and 257 mounted on the upper portion of upper push rod 253. As the pistons 212 and 222 continue their leftward movement, cam 223 of drive piston 222 (lower portion of FIG. 21) will engage cam follower 259 moving the spool 252 downwardly under the influence of lower push rod 254 whereupon the shoulder 292 of spool 252 will close recess 272 disconnecting or interrupting the flow of pressurized fluid from pump #2 (FIG. 19) through the four-way valve inlet port 275 out recess 272, over line L3 and through rearward inlet port 283 of drive cylinder 230 thereby halting the advancement of drive piston 212. This causes the drive piston 212 to cease pressurizing fluid and supplying the pressurized fluid to the fluid pressure intensifier outlet 290. As the spool 252 continues to move downwardly under the influence of the cam 223, cam follower 259 and lower push rod 254, the spool 252 is moved downwardly sufficiently such that recess 272 is uncovered to or communicated with recess 271 thereby venting and exhausting drive cylinder 230 through rearward inlet port 283, line L3, recess 272, recess 271 and outlet port 276 of the four-way valve 250 to the oil sump (FIG. 19) whereupon the constant input pressure from pump #3 (FIG. 19) over line L7 through forward inlet port 288 begins to drive or retract piston 212 rearwardly in drive cylinder 230 and simultaneously relatively low pressure fluid from the transfer sump (FIG. 19) is admitted through one-way valve V3, line L5 and forward inlet port 286 to the forward portion of high pressure pump cylinder 210—it will be noted that due to the spring biased mounting of cams 213 and 214 on piston 212 that upon rearward movement of piston 212 the cams 213 and 214 apply no force to cam followers 256 and 257 but instead the cams 213 and 214 are pivoted out of the way against the action of their respectively associated biasing springs shown. Thus, it will be understood that it is the advancement of the drive piston 222 to a predetermined first forward axial position (i.e. the forward axial position of drive piston 222 at which cam 223 engages cam follower 259) that causes cessation of advancement and retraction of the drive piston 212 and the supply of high pressurized fluid by the high pressure pump 202A to the outlet port 290 of the intensifier 202. Further, it will be noted that upon the above-described downward movement of the spool 252, no effect was had on drive cylinder 240 or the forward axial advancement of the drive piston 222 as the high pressure input to the rearward inlet port 284 of drive cylinder 240 was continued from pump #2 (FIG. 19) through rearward inlet port 284 of the drive cylinder 240, through line L4, through recess 273 and inlet port 275 of four-way valve 250. It will be understood that the continued downward movement to the spool 252 under the influence of cam follower 223 displaces the spool 252 downwardly sufficiently to place the cam follower 258 in the path of cam 224, and upon engagement of cam follower 258 by cam 224 can 224 through push rod 254 imparts upward axial movement to spool 252 returning it to its original or center position shown in FIG. 21 and a reciprocation sequence cycle is completed—however, it will be noted that such upward movement of spool 252 had no effect on drive cylinder 240 as drive cylinder 240 continued to drive the piston 222 leftwardly because the pressurized fluid from pump #2 (FIG. 19) through inlet port 275 of the four-way valve 250 was continuously supplied through recess 273 over line L4 and through the rearward inlet port 284 to the rear of drive cylinder 240 to continuously drive the piston 222 leftwardly. Now, with the spool 252 returned to its original central position shown in FIG. 21 by the above-described action initiated by cam 224, both drive cylinders 230 and 240 are again advancing their respective drive pistons 212 and 222 forwardly due to pressurized fuid being supplied from pump #2 (FIG. 19) through inlet port 275 of the four-way valve 250, recesses 272 and 273, lines L3 and L4, and through respective rearward inlet ports 283 and 284 to drive cylinders 230 and 240.

Upon sufficient leftward movement or axial displacement of drive piston 212, cam 213 will engage cam follower 256 to move the spool 252 upwardly under the influence of upper push rod 253 and spring 255 (The spring being sufficiently stiff with respect to the force imparted by the single cam 213 to act as a solid connection to the push rod 253) to close recess 273 to the inlet port 275 of the four-way valve 250 thereby halting or interrupting flow of pressurized fluid from pump #2 (FIG. 19) to the rear of drive cylinder 240, and upon continued upward movement of the spool 252 under influence of cam 213, recess 273 is uncovered to or communicated with recess 274 thereby venting and exhausting drive cylinder 240 through rearward inlet port 284, line L4, recesses 273 and 274 and outlet port 277 of the four-way valve 50 to the oil sump (FIG. 19) whereupon the constant input pressure from pump #3 (FIG. 19) over line L8 through forward inlet port 289 begins to drive or retract piston 222 rearwardly in drive cylinder 240 and simultaneously relatively low pressure from the fluid transfer sump (FIG. 19) is admitted through one-way valve V4, line L6, and forward inlet port 287 to the forward portion of high pressure pump cylinder 220—it will be noted that due to the spring biased mounting of cams 223 and 224 that upon rearward movement of drive piston 222 the cams 223 and 224 apply no force to the cam followers 258 and 259 but instead are pivoted out of the way against the action of their respectively associated biasing springs shown. Thus, it will be understood that it is the advancement of the drive piston 212 to a predetermined first axial position, i.e. the forward axial position of drive piston 212 at which cam 213 engages cam follower 256, that causes cessation of advancement and retraction of the drive piston 222 and the supply of high pressurized fluid by the high pressure pump 202B to the outlet port 290 of the intensifier 202. Further, it will be noted that upon the above-described downward movement of spool 252, no effect was had on drive cylinder 230 or the forward axial advancement of the drive piston 212 as the high pressure input to the reaward inlet port 283 of drive cylinder 230 was continued from pump #2 (FIG. 19) through rearward inlet port 283 of the drive cylinder 230, through line L3, through recess 272 and inlet port 275 of the four-way valve 250. It will be understood that the continued upward movement of the spool 252 under the influence of cam follower 213 displaces the spool 252 upwardly sufficiently to place the cam follower 257 in the path of cam 214, and upon engagement of cam follower 257 by cam 214, cam 214 through upper pugh rod 253 imparts downward axial movement to spool 252 returning it to its original or center position shown in FIG. 21—however, it will be noted that such downward movement of spool 252 had no effect on drive cylinder 230 as drive cylinder 230 continued to drive the piston 212 leftwardly because of the pressurized fluid from pump #2 (FIG. 19) through inlet port 275 of the four-way valve 250 was continuously supplied through recess 272 over line L3 and through the rearward inlet port 283 to the rear of drive cylinder 230 to continuously drive the piston 212 leftwardly. Now, with the spool 252 returned to its original central position shown in FIG. 21 by the above-described action initiated by cam 214, both the drive cylinders 230 and 240 are again advancing their respective drive pistons 212 and 222 forwardly due to pressurized fluid being supplied from pump #2 (FIG. 19) through inlet port 275 of the four-way valve 250, recesses 272 and 273, lines L3 and L4, and through respective rearward inlet ports 283 and 284 to drive cylinders 230 and 240. Whereupon. the above-described reciprocation sequence is continuously reperated during operation of the fluid pressure intensifier 202.

It will be noted at all times during the above-described reciprocation sequence that at least one of the drive pistons 212 or 222 is moving forward to cause at least one of the high pressure pumps 202A or 202B to deliver pressurized fluid to the intensifier outlet 290 and that at portions of the above-described reciprocation sequence both drive pistons 212 and 222 were moving forward to cause both high pressure pumps 202A and 202B to deliver pressurized fluid to the intensifier outlet 290; accordingly, it will be understood that fluid pressure intensifier 202 of the present invention continuously, or at least substantially continuously, provides pressurized fluid at the outlet 290 at a constant, or substantially constant, pressure.

It will be further understood that a safety feature is provided to the fluid pressur intensifier 202 of the present invention by the compression spring 255. Should cam 213 be engaging cam follower 256 while cam 223 is simultaneously engaging cam follower 259 (tending in essence to elongate spool 252), the force applied simultaneously by both cams 213 and 223 will be sufficient to compress the spring 255 between the washers 263 and 264 with the upper push rod 253 moving axially upwardly within the spool 252. Should cam 214 be engaging cam follower 257 while cam 254 is simultaneously engaging cam follower 258 (tending in essence to compress spool 252), the forces imparted simultaneously by both cams 214 and 224 are sufficient to compress the spring 255 with the upper push rod 253 sliding axially downwardly within and with respect to the spool 252 and with the reduced diameter portion 261 of the upper push rod 253 moving downwardly through the washer 264. Such spring compression prevents breakage, jamming or mal-function of the four-way control valve 250 and hence the fluid pressure intensifier 220.

Accordingly, it will be understood that the improved fluid pressure intensifier of the present invention facilitates alignment of the continuous moving chamber 21 (FIG. 1) with the apparatus center-line 26 (FIG. 1) and maintenance of the circularity of the cross-sectional geometric shape of the continuously moving chamber 21 by providing continuous, or substantially continuous, flow of pressurized fluids at a constant, or substantially constant, pressure to the high and low pressure zones of the hydrostatic bearings 24 which through the endless belt 23 produce the inward compressive support stress to the gripping element members 18 illustrated in FIG. 17.

It will be further understood by those skilled in the art that upon the extrusion of wire 12 (FIG. 1) particles of wire may enter between and adhere to the sides of the gripping element members 18 particularly the portions of the sides adjacent the face portion providing the central aperture or bore 27 (FIG. 2). Such wire particles can cause misalignment of the gripping element members 18 particularly upon their converging at the entrance end 15 (FIG. 1) of the extrusion apparatus 10 to provide the continuous moving chamber 21; this misalignment can distort the circularity of the continuous moving chamber 21 sufficiently to impair extrusion. The present improvement invention, referring to FIG. 22, further includes air blast apparatus indicated by general numerical designation 120 for removing particles of wire adhering to such sides of the gripping element members 18 upon the gripping element members diverging at the exit end 17 of the apparatus 10. The air blast apparatus 120 may include air blast apparatus 121 and 122 associated respectively with said trains of gripping element members 18 as shown. The air blast apparatus are rotatble as indicated by arrows 123 and 124 by being engaged and rotated by their associated trains of gripping element members 18 after the gripping element members diverge at the exit end 17 of the apparatus 10 and continue on their endless paths 19 (FIG. 1).

Figure 23:
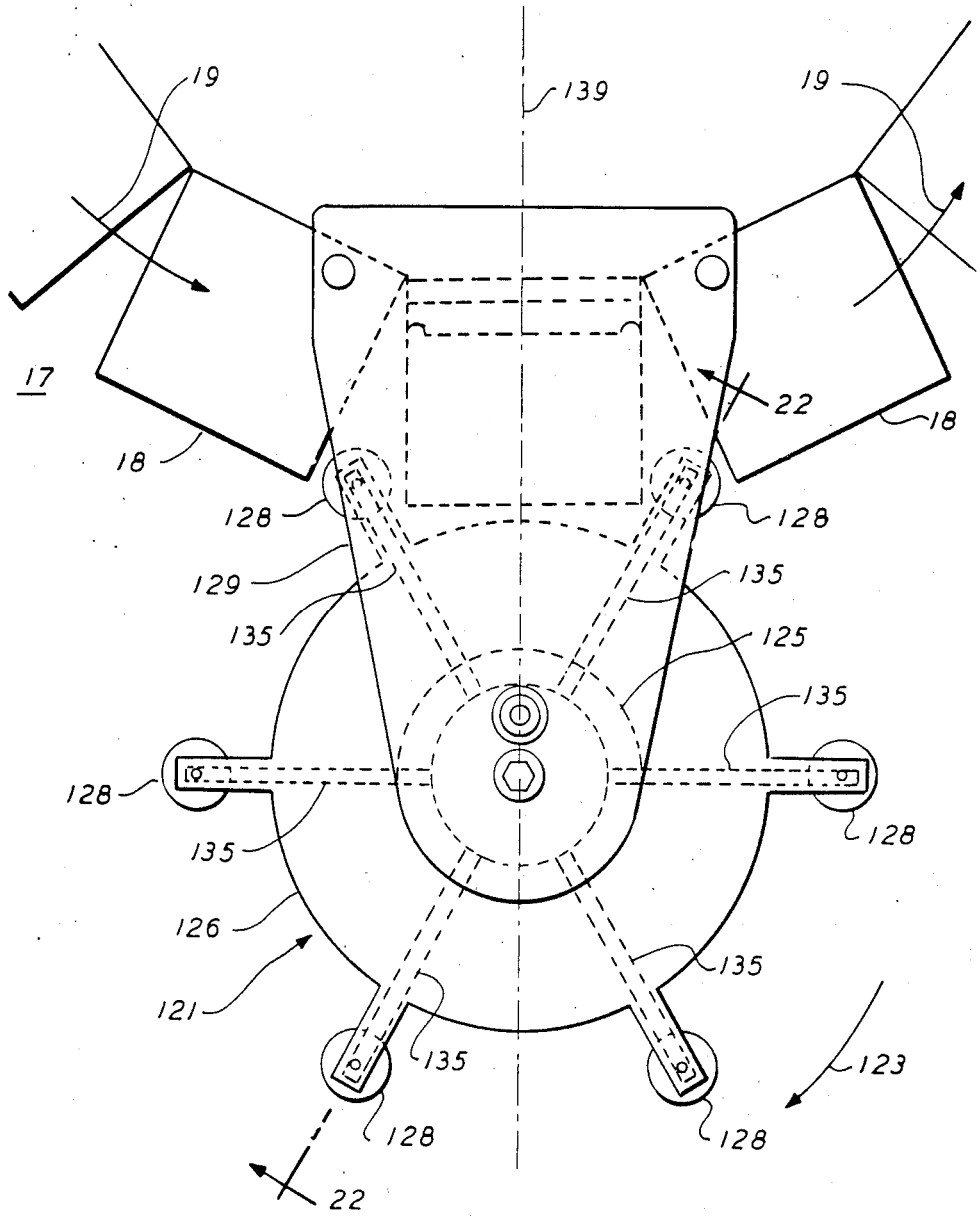
Figures 24, 25:
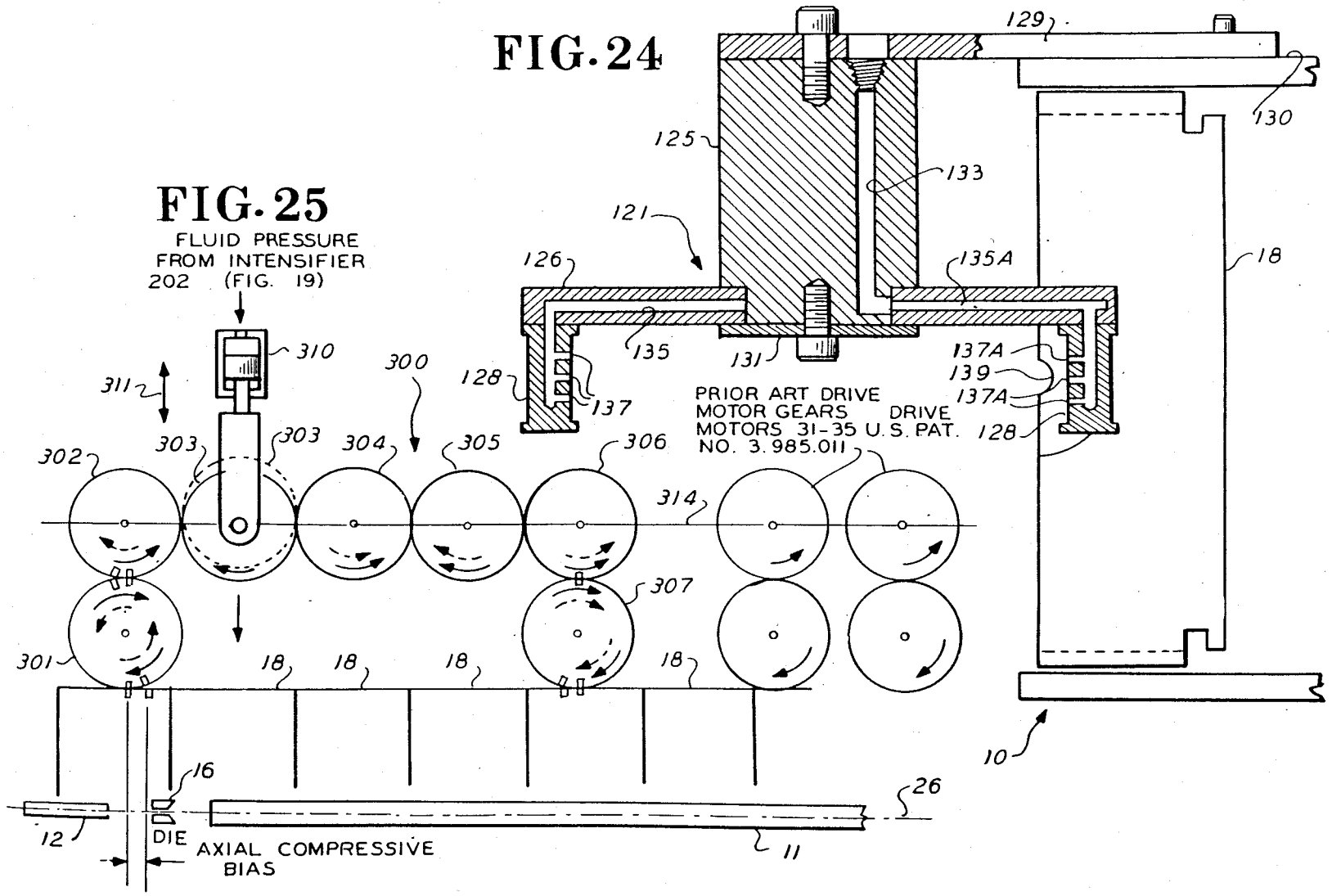

Air blast apparatus 123 is shown in detail in FIGS. 23 and 22 and it will be understood that air blast apparatus 122 is of the same structure and function. Air blast apparatus 121 includes a stationary hub 125, a plate or disc 126 mounted rotatably on the hub at the lower end thereof and a plurality of radially disposed nozzle spools 128 mounted on the disc for rotation therewith. The stationary hub 125 is mounted at the exit end 17 (FIG. 22) of the continuous extrusion apparatus 10 by mounting plate 129 suitably secured, such as by threaded bolts, to the top plate 130 of continuous extrusion apparatus 10; the hub 125 is suitably mounted to the mounting plate 129 by the threaded bolt as shown in FIG. 24 and the rotatable disc 126 is suitably mounted on the hub 125 by plate 131 and a suitable threaded member as also shown in FIG. 24. As may be best seen in FIG. 24, the hub 125 is provided with a vertical air channel 133 extending downwardly therethrough and the rotatable disc 126 is provided with a plurality of radially disposed air channels 135 extending horizontally therethrough each communicating with air outlets 137 of one of the nozzle spools 128. The upper portion of vertical air channel 133 (FIG. 24) is threaded for ready communication with a suitable source of pressurized air, not shown. Upon the rotatable air blast apparatus 121 being rotated by engagement by the train of gripping element members 18, FIG. 23, until one nozzle spool 128 is aligned with the center-line 139 of gripping element members 18, the rotatable air blast apparatus 121 will occupy the position shown in FIG. 24, horizontal air channel **135*a* (FIG. 24) is aligned and placed in communication with vertical air channel 133 and pressurized air is communicated through the vertical air channel 133, horizontal air channel 135*a* to and through air outlets 137*a* to provide a blast of air for removing any debris, such as particles of extruded wire 12, adhering to the sides of the gripping element members 18 particularly the side portions of the gripping element members 18 adjacent the curved face portion 139 which cooperates to provide the central aperture or bore 27 (FIG. 2). As the train of gripping element members 18 continues on its endless path 19 for continuous extrusion, the gripping element members 18 function as gears, as may be best understood from FIG. 23, engaging the nozzle spools 128 and imparting rotation to the rotatable disc 126 whereupon the horizontally disposed air channels 135 are placed sequentially in communication with vertical air channel 133 as the horizontal air channels 135 are sequentially rotated into alignment with the center-line 139 (FIG. 23) of the train of gripping elements 18** to provide the cleaning blasts of air.

Figure 26:
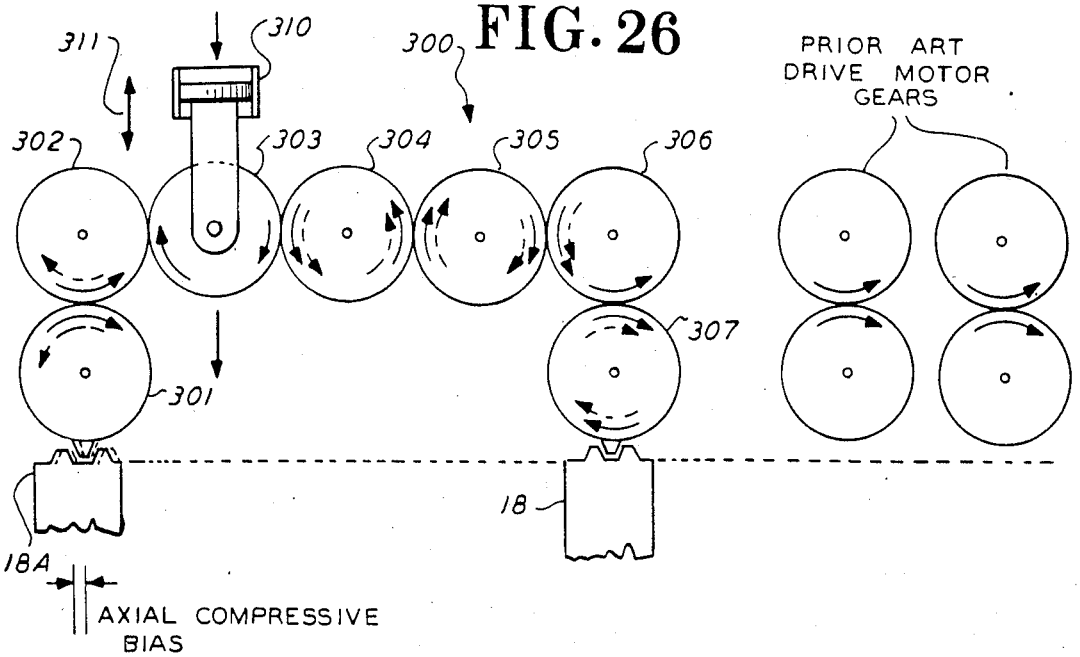

Referring again to my incorporated prior patent, U.S. Pat. No. 2,985,011, particularly at column 7, lines 5–15, hydraulic braking action, provided by motors 35 as described, was provided to maintain sufficient back pressure downstream of the die 22 to clamp the gripping element quadrants 13 of each train together along the X direction such as to prevent leakage of the wax 66 between the quadrants, etc. The motors 35, a described in my incorporated patent, are connected to the hydraulic circuit of the drive motors and it has been found that due to starting, stopping and variable speed action of such hydraulic drive motors, the hydraulic braking action applied by my prior system to the gripping element members or quadrants varied permitting the gripping element members or quadrants to separate and change their relative geometric positions, distort the circular geometric shape of the moving centrally apertured chamber in which the rod 11 to be deformed is advanced and permitted the rod 11 to flash between the gripping element members even interrupting the extrusion process. The separation problem of the gripping element quadrants or members has been overcome by my present improvement invention as will be understood in accordance with the further teachings of my present improvement invention as set forth with regard to my novel axial compression gear system 300 illustrated in FIGS. 25 and 26 and my alternate embodiment novel axial compression gear system 400 illustrated in FIG. 27. Generally, it will be understood that the axial compression gear systems 300 and 400 are for applying, prior to extrusion of the rod 11, axial compressive bias, indicated by the opposed arrows in the lower left portion of FIGS. 25 and 27 to successive ones of the gripping element members 18 a distance upstream and downstream of the extrusion die 16 as illustrated diagrammatically particularly in FIGS. 25 and 27. The axial compressive bias forces successive ones of the gripping element members into tight or firm compressive engagement as they come under the influence of the axial compression gear system thereby preventing separation of the gripping element members during extrusion of the rod 11 into wire 12 and preventing the above-noted prior art problems associated with my prior hydraulic braking system disclosed in my incorporated patent; the axial compression gear systems 300 and 400 additionally assist the keys 46 and 47 (FIGS. 5A and 5B) in maintaining the gripping element members 18 in axial alignment with the center-line 26 (FIG. 1) of the apparatus 10 and in maintaining the centrally apertured continuously moving pressure chamber 21 (FIG. 1) and its predetermined round geometric shape. Referring now to FIGS. 25 and 26, and first to FIG. 25, the axial compression gear system indicated by general numerical designation 300 includes a plurality of engaged rotatable gears 301–307 with gears 301 and 307 placed in engagement with the gripping element members 18 of one of the trains of gripping element members 19 (FIG. 2). All of the rotatable gears except gear 303 are mounted stationarily and gear 303, as shown, is mounted for reciprocal movement by the piston 310 under the influence of, for example, fluid pressure intensifier 202 (FIG. 19) in the directions of the double-headed arrow 311. It will be understood that the initial position of the rotation center of gear 303 may be either above or below the center-line 314 of the stationarily mounted gears 302, 304–306, and that in the embodiment illustrated in FIG. 25 the initial position of the center of rotation of reciprocably mounted gear 303 is above the center-line 314 as indicated by the dashed outline showing gear 303. Upon downward movement being imparted to the reciprocably mounted gear 303 by the piston 310 to occupy the solid line showing gear 303, rotational bias is applied to the other gears by gear 303 as indicated by the dashed arrows (the absolute direction of rotation of such gears being indicated by the solid arrows) and it will be understood that this rotation bias indicated by the dashed arrows causes gears 301 and 307 in engagement with the gripping element members 18 to provide the axial compressive bias indicated by the opposed arrows in the lower left-hand portion of FIG. 25. The axis compressive bias applied to the gripping element members 18 may be further understood by reference to FIG. 26 wherein such axial compressive bias is indicated by engagements between the teeth of gears 301 and 307 with the teeth of the gripping element members 18. The rotational bias imparted to gear 301 by the downward movement of reciprocably mounted gear 303 is indicated not only by the dashed arrow but also by the positions of the tooth of gear 301 shown in dashed line and the teeth of the gripping element 18A shown in dashed line. These dashed teeth illustrate the axial compressive bias applied by the axial compression gear system 300 and provide a further understanding of the function of the axial compression gear system 300.

Figure 27:
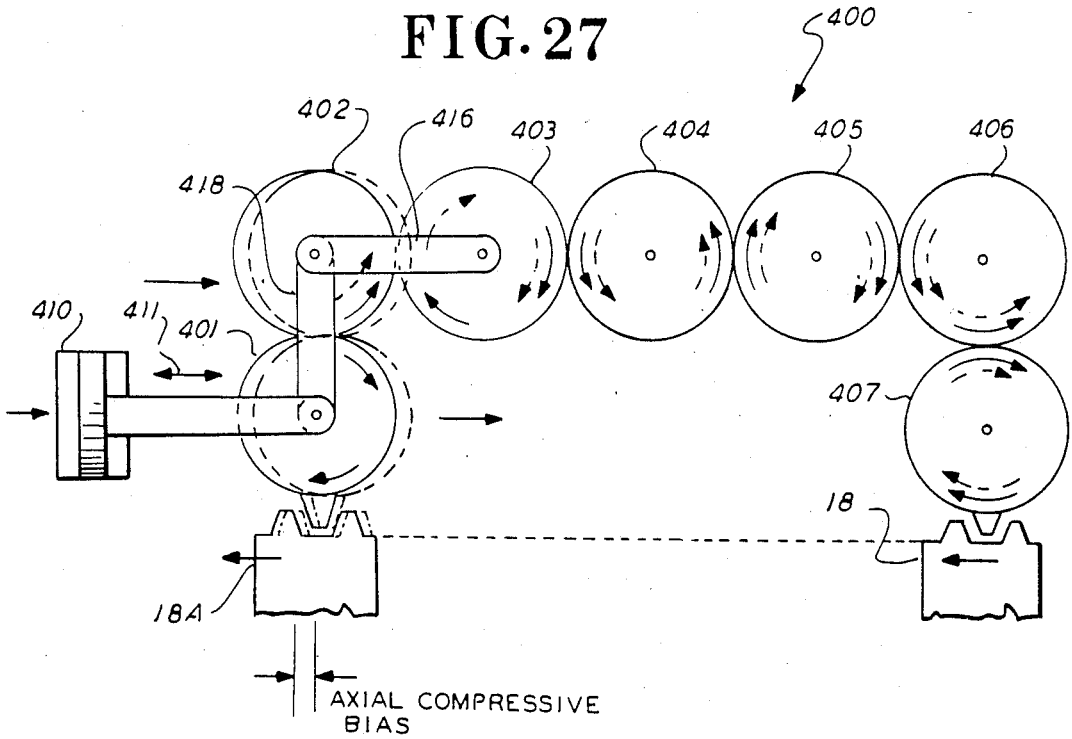
FIG. 27 is an alternate embodiment of the axial gear compression system illustrated in FIGS. 25 and 26.

An alternate embodiment of my novel axial compression gear system is illustrated in FIG. 27 and embodied in axial compression gear system indicated by general numerical designation 400. Axial compression gear system 400 is substantially the same as axial compression gear system 300 except that in this embodiment rotatble gears 404-407 are mounted stationarily and gears 401 and 402 are mounted for reciprocal movement. Gear 402 rotates about the center of rotation of gear 403 on arm 416 and gear 404 rotates about the center of rotation of gear 403 on arm 416 connected to the center of gear 402. Upon rightward movement being imparted to gear 401 by the hydraulic piston 410, such as for example in the same manner of operation of piston 310 of FIG. 25, gears 401 and 402 impart rotational bias to stationarily mounted gears 403–407 in the directions of the dashed arrows (the absolute direction of rotation of the rotatable gears being indicated by the solid arrows) and gears 401 and 407 in engagement with gripping element members 18 provide axial compressive bias to the gripping element members as indicated by the opposed arrows in the lower lefthand portion of FIG. 27; the axial rotation bias is also indicated by the dashed outline positions of the tooth of gear 401 in engagement with the teeth of gripping element member 18A as shown in dashed outline.

Referring to the drive gears indicated in FIGS. 25 and 26 (such drive gears not being shown in FIG. 27 but it will be understood that such drive gears are present) such drive gears may be for example the drive gears 31–35 of my incorporated U.S. Pat. No. 3,985,011.

It will be understood by those skilled in the art that many modifications and variations of the present invention may be made without departing from the spirit and the scope thereof.

What is claimed is:

1. Fluid pressure intensifier, comprising:

first and second relatively high pressure pump means each including a drive piston mounted for reciprocating sliding axial movement into axial positions, said first and second relatively high pressure pump means for independently receiving a relatively low pressure fluid and pressurizing said fluid into a relatively high pressure;

an intensifier output;

control means for controlling the reciprocation sequence of said first and second high pressure pump means to cause said pump means to deliver said fluid pressurized to said relatively high pressure to said intensifier output at a substantially continuous flow and at a substantially constant pressure;

said control means operable in accordance with respective predetermined axial positions of said drive pistons, and wherein said first and second pump means each further include a high pressure pump cylinder and a drive cylinder aligned axially with respect to each other and with respect to said drive piston and wherein the forward portion of said drive piston is mounted reciprocably in said high pressure pump cylinder and wherein the rearward portion of said reciprocably mounted drive piston is mounted reciprocably in said drive cylinder, said drive piston provided intermediately with a pair of axially displaced and oppositely disposed predetermined spring biased cams and wherein said first and second pump means are positioned in predetermined parallel and laterally displaced positions with respect to each other, each said high pressure pump cylinder for receiving relatively low pressure fluid at its ends which is pressurized to a relatively high pressure upon said drive piston being advanced by said drive cylinder whereupon said relatively high pressure fluid is delivered to said intensifier ouput, the forward portion of each of said drive cylinders for being constantly communicated with a source of first pressurized drive fluid to cause said drive cylinder to retract said drive piston;

wherein said control means comprise a four-way control valve including a valve cylinder having a spool mounted therein for reciprocating sliding axial movement, and a pair of push rods mounted at opposte ends of said spool and extending axially outwardly through said valve cylinder, each push rod provided with a pair of axially displaced cam followers, said control valve positioned at a predetermined position between said first and second pumps and oriented perpendicularly with respect thereto, said spool normally occupying a central position within said valve cylinder with a predetermined cam follower of each push rod engageable by a predetermined cam of one of said drive pistons upon the advancement thereof; and said four-way control valve for being connected to a source of second pressurized drive fluid and upon said spool occupying said central position said second pressurized drive fluid for bein communicated through said control valve to the rear of said drive cylinders to cause said drive cylinders to advance said drive pistons within said high pressure pump cylinders, upon each of said drive pistons being advanced into a predetermined axial position said predetermined cam engaging said predetermined cam follower of a predetermined one of said push rods to impart first predetermined axial movement to said spool to disconnect and vent said second pressurized drive fluid from the drive cylinder of the other of said drive pistons to halt the advance thereof while said second pressurized drive fluid is maintained communicated to the drive cylinder of each drive piston, and upon said each drive piston being advanced to a second predetermined axial position, the other of its cams engaging the other cam follower of said predetermined push rod to impart axial movement to said spool in a direction opposite to said first axial movement to return said spool to its central position and upon the advance of said drive piston being halted said first pressurized drive fluid retracting said each drive piston, upon said axial-movements of said spool a predetermined reciprocation advancement sequence imparted to said drive pistons to cause at least one of said drive pistons to be advanced at all times to cause said pumps to deliver at said intensifier output a substantially continuous flow of said relatively high pressure fluid at a substantially constant pressure.

* * * * *